US005298924A

United States Patent [19]

Matsumoto

[11] Patent Number: 5,298,924

[45] Date of Patent: Mar. 29, 1994

[54] MULTIPLE PRINTING APPARATUS

[75] Inventors: Mitsuyuki Suzuki, Shiki, Japan
Kazumi Sakai, Shiki, Japan

[73] Assignee: Autonics Co., Ltd., Shiki, Japan

[21] Appl. No.: 967,689

[22] Filed: Oct. 27, 1992

[30] Foreign Application Priority Data

Nov. 2, 1991 [JP] Japan ..... 3-315386

[51] Int. Cl.[5] ..... B41J 2/325
[52] U.S. Cl. ..... 346/76 PH
[58] Field of Search ..... 346/76 PH; 400/120

[56] References Cited

U.S. PATENT DOCUMENTS 4,290,357 7/1981 Clay ..... 101/111
4,540,992 9/1985 Moteki et al. ..... 346/76 PH
4,571,598 2/1986 Shinozaki et al. ..... 346/76 PH

FOREIGN PATENT DOCUMENTS 0122769 6/1987 Japan ..... 400/120
0154374 6/1988 Japan ..... 400/120
8804132 3/1988 World Int. Prop. O. .

*Primary Examiner*—Benjamin R. Fuller
*Assistant Examiner*—Huan Tran
*Attorney, Agent, or Firm*—Nields & Lemack

[57] ABSTRACT

A multiple printing apparatus is capable of performing multiple printing, e.g. multi-stage printing, multi-color printing at extremely high speed by one sequence of feed in one direction. The multiple printing apparatus comprises a plurality of printing heads arranged in series along a direction of motion a printing object in relative movement between said printing heads and said printing object, and control means for selectively controlling each of the printing heads between operative position and inoperative position independently of the other printing heads.

5 Claims, 5 Drawing Sheets

MULTIPLE PRINTING APPARATUS

BACKGROUND OF THE INVENTION

1. Field of the Invention

The present invention relates generally to a multiple printing apparatus. More specifically, the invention relates to a multiple printing apparatus which can perform overlapping printing.

2. Description of the Related Art

It has been widely spread in manufacturing plants and so forth to attach labels with printed bar code or so forth on parts for mechanical or visual identification. Nowadays, there are needs for coloring of the labels for easier identification. Also, there is a trend to develop mechanical color recognition apparatus to increase density of label information.

However, in order to cope with such coloring of the labels, it becomes necessary to separate ink ribbons as printing mediums into respective colors and to control shifting of these ink ribbons so as to register the label as a printing object at a desired color position for printing. This inevitably makes a shift control mechanism complicate. Also, when a multi-color printing or color overlapping is required, it becomes necessary to perform printing with reciprocally shifting the printing object to make the shift control mechanism further complicate and to require long period for printing.

It may be a solution for such problem to arrange printing apparatuses in multi-stage for printing different colors in different printing apparatuses. However, in such case, cost for facility becomes significantly high and the length of line of the printing apparatus becomes too long.

SUMMARY OF THE INVENTION

Therefore, it is an object of the present invention to provide a multiple printing apparatus which can solve the foregoing problems.

In order to accomplish the above-mentioned object, a multiple printing apparatus, according to the present invention, generally comprises a plurality of printing heads arranged in series along a direction of motion a printing object in relative movement between said printing heads and said printing object, and control means for selectively controlling each of the printing heads between operative position and inoperative position independently of the other printing heads.

The printing object moves relative to the printing heads. Namely, either of said printing object per se or the printing heads moves relative to the other.

As the printing head, a thermal printing head, a dot impact printer head, a laser printer head or so forth may be employed. The printing head is adapted to vertical movement for shifting upwardly to the throw-off position. With the construction set forth above, maintenance, inspection, replacement of the printing head can be performed at the throw-off position. As a result of this, printing heads can be arranged in series along the moving direction of the label with high density. Therefore, the length of the printing line can be minimized.

In case that the thermal printing or dot impact printing heads as printing head, the printing medium, such as an ink ribbon is essential. In the preferred embodiment of the invention, the printing medium is provided for each printing head to permit printing of different colors at different printing heads. In the preferred construction, the printing medium is provided in a form of a roll and arranged above the printing head. In the further preferred embodiment, the printing medium is set on a feeding roll and a take-up roll, which are arranged in stepwise fashion at corresponding positions to the corresponding printing heads in the label moving direction. The printing heads are moveable from the stepwise arranged positions to the printing positions. Furthermore, with the arrangement pattern set forth above and motion of the printing heads, the printing line length can be shortened. In addition, it facilitates connection of equipments in the following stage.

When the printing heads are adapted for thermal printing and in the preferred embodiment, the printing heads are placed at a fixed position upon printing. Depressing means are provided beneath the printing object. By this depression means, the printing object is urged onto the printing head for permitting printing.

BRIEF DESCRIPTION OF THE DRAWINGS

The present invention will be understood more fully from the detailed description given herebelow and from the accompanying drawings of the preferred embodiment of the invention, which. however, should not be taken to be limitative to the invention but are for explanation and understanding only.

In the drawings.

DESCRIPTION OF THE PREFERRED EMBODIMENT

An embodiment of the present invention will be discussed herebelow with reference to the drawings.

Figure 1:
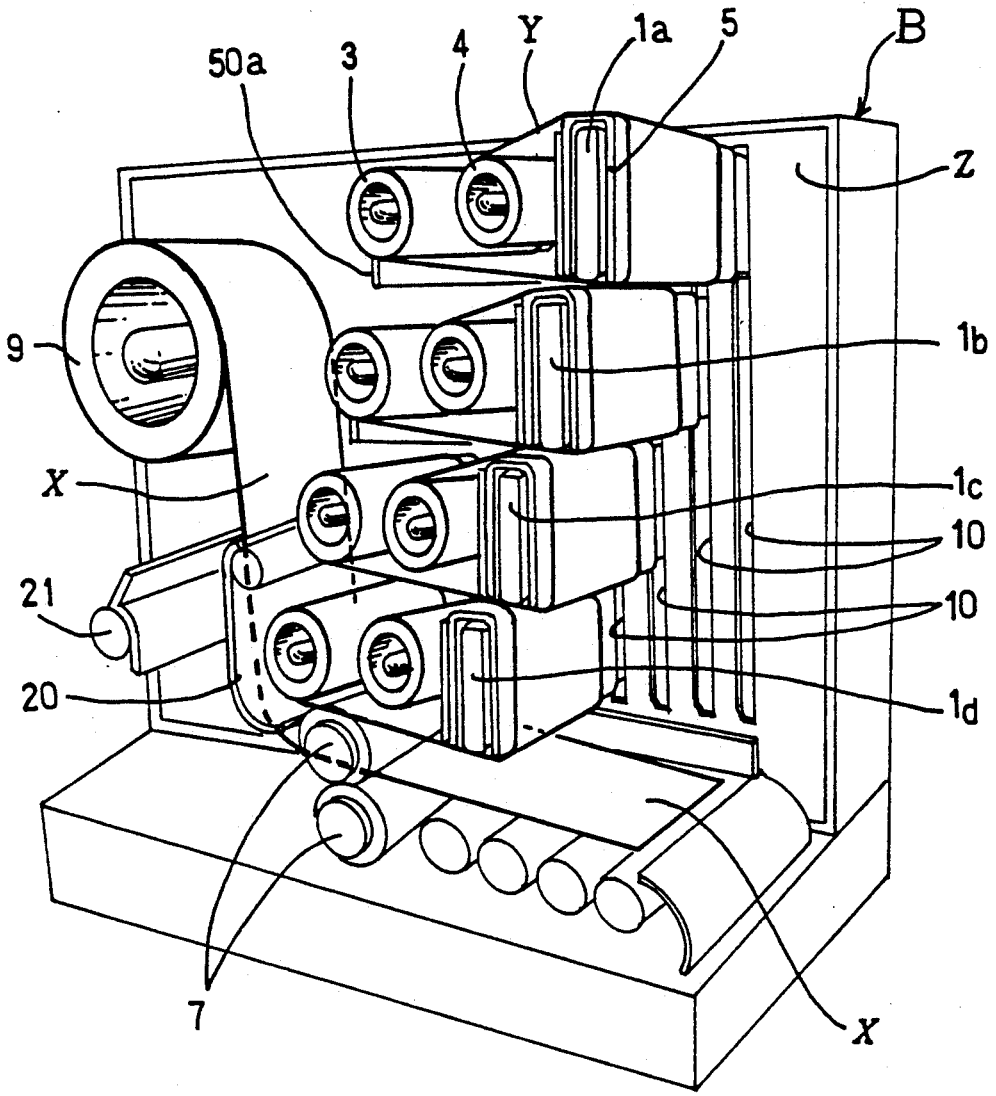
FIG. 1 is a schematic perspective showing one embodiment of the invention.
Figure 2:
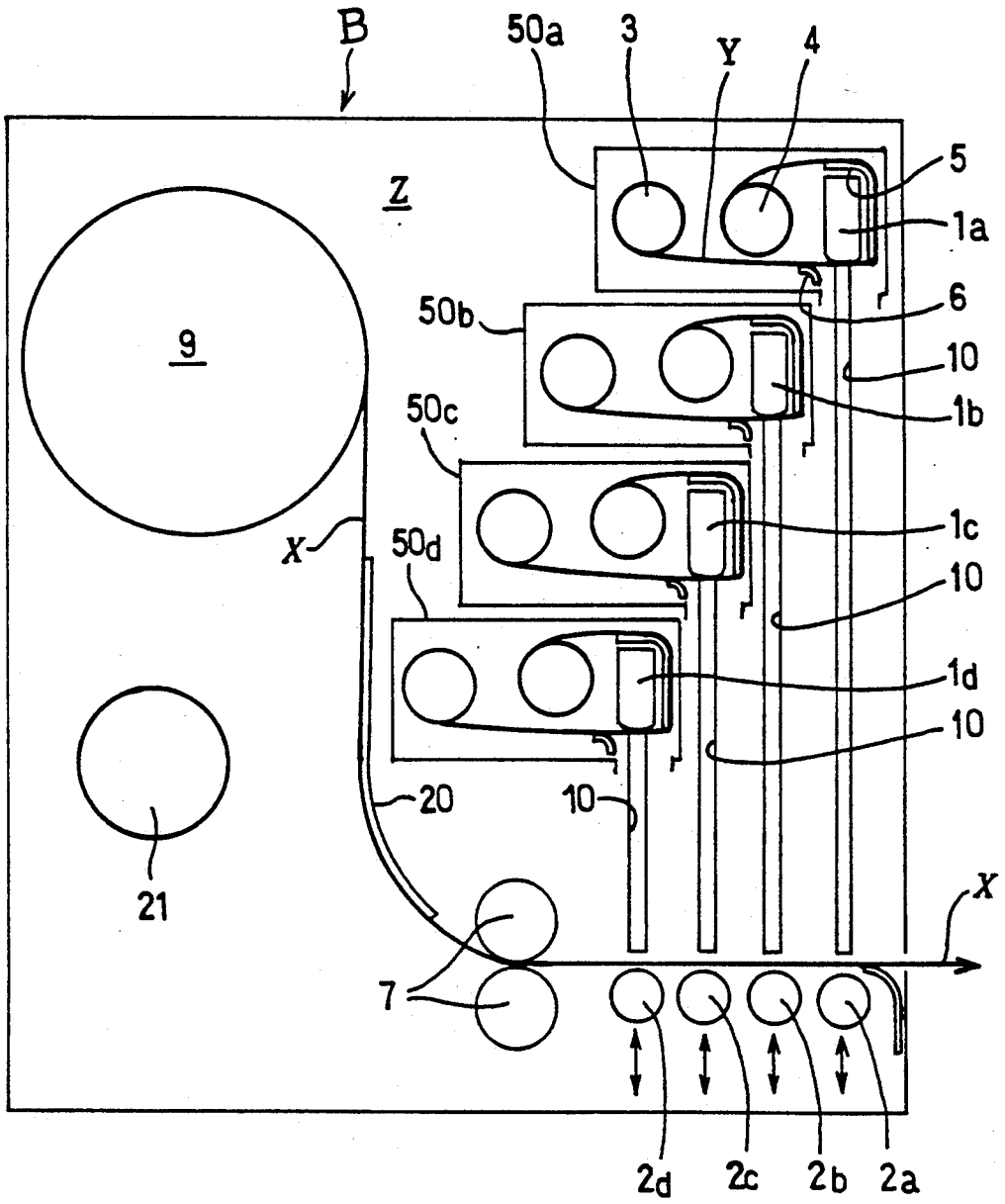
FIG. 2 is a front elevation showing one embodiment of the invention.
Figure 3:
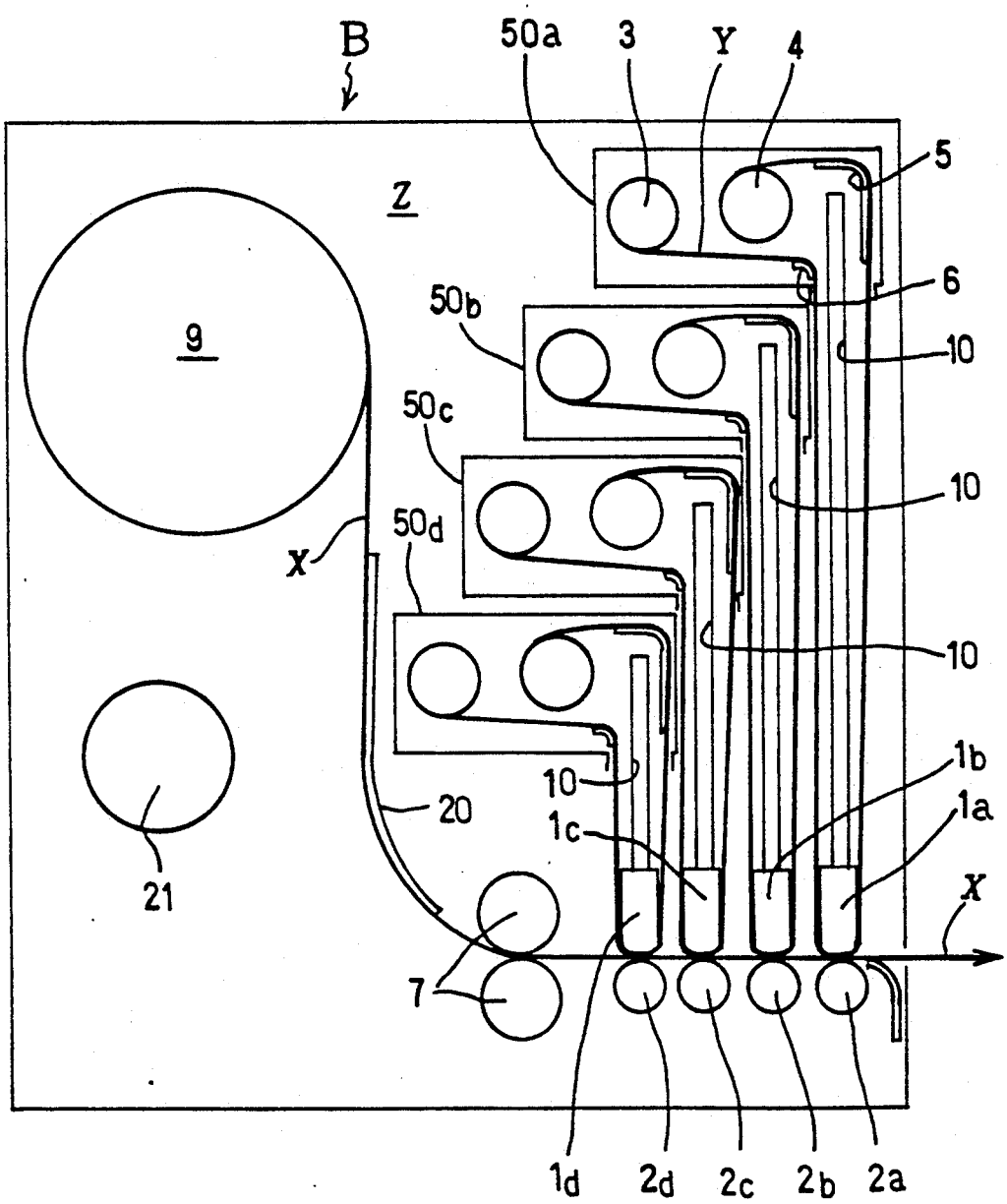
FIG. 3 is a front elevation illustrating a condition where a printing head 1 is lowered.

In FIG. 1, a plurality of thermal printing heads which are represented by the reference numeral 1 as generally referred to, are horizontally projected from a vertical wall Z of a main body B. In the shown embodiment, four printing heads 1 are provided and arranged in series along a feeding direction of a label X as a printing object. The printing heads 1 are vertically movable. The printing head 1*a* positioned at the most downstream side relative to the feeding direction of the label X (toward right in FIG. 2) is movable at the highest elevated position. The maximum elevated positions of the remaining printing heads 1*b*, 1*c* and 1*d* are lowered in order. In the vertical wall Z of the main body B, four vertical guide rails 10 are cut out. The printing heads 1 are supported in the vertical guide rails 10 in vertically movable fashion. Namely, the printing heads 1 are supported on the vertical wall Z in cantilever fashion. The printing heads 1 are adapted to be latched by latching mechanism (not shown) at the uppermost and lowermost positions. The printing heads 1 are adapted to perform printing on the label X at the lowermost positions. On the other hand, the uppermost positions are set as throw-off positions, at which setting of ink ribbon and so forth are to be performed. FIG. 3 shows the printing heads 1 placed at the lowermost positions.

Ink ribbons Y for respective printing heads 1 are differentiated in color. In the shown embodiment, ink ribbons Y are respectively adapted for color printing of magenta, blue, yellow and black. Multi-color printing is thus enabled by solely or overlappingly printing these colors. Each ink ribbon Y is provided in a form of a roll to be fed from a feeding reel 3 and wound on a take-up reel 4. In the shown embodiment, the feeding reel 3 and the take-up reel 4 are housed in a cassette which is represented by the reference numeral 50 as generally referred to and thus can be mounted to and removed from the vertical wall Z of the main body B together in the form of cassette. The cassette 50 is provided with an outer guide 5 and an inner guide 6 so that the ink ribbon path is established to feed the ink ribbon Y over the inner guide 6, beneath the printing head 1 and then to the take-up reel 4 along the outer guide 5. The cassette 50 is also formed with a lower end opened cut out between the outer guide 5 and the inner guide 6 to receive the printing head 1. Therefore, the printing head 1 can be received within the cassette 50 at the uppermost position thereof. When the printing head 1 moved downwardly from the uppermost position to the lowermost position, the ink ribbon Y is also extracted to reach the lowermost position together with the printing head.

The cassette 50 is provided for each printing head 1*a*, 1*b*, 1*c* and 1*d*. Therefore, in the shown embodiment, four cassettes 50*a*, 50*b*, 50*c* and 50*d* are mounted on the vertical wall in vertically overlapping manner. Respective of the cassettes 50*a*, 50*b*, 50*c* and 50*d* are extended in order in the feeding direction of the label X corresponding to the horizontal positions of respectively corresponding printing heads 1.

Figure 4:
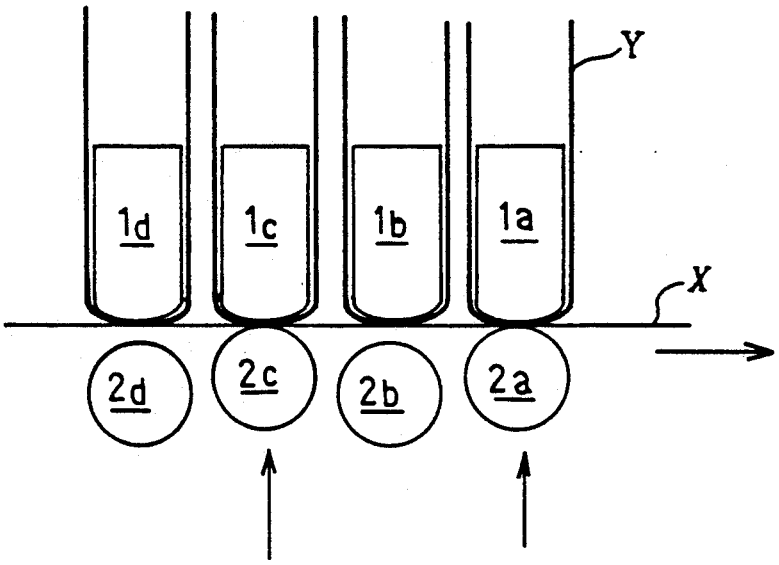
FIG. 4 is an enlarged partial illustration showing operation of depression rollers 2 and printing heads 1.

FIG. 4 shows the conditions of the printing heads 1 at the lowermost position. The ink ribbons Y are wrapped beneath the printing heads 1. The label X is fed through the positions beneath the ink ribbons Y. In the shown embodiment, depression rolls 2*a*, 2*b*, 2*c* and 2*d* are provided below respective of the printing heads 1 in opposition thereto, which depression rolls may also be represented by the reference numeral 2 as generally referred to. These depression rolls 2 are movable in the vertical direction. At the upwardly shifted position, the depression roll 2 depresses the label X onto the ink ribbon Y and the printing head 1 for enabling printing. In FIG. 4, the depression rolls 2*a* and 2*c* are shifted upwardly to depress the label X to perform printing with the corresponding printing heads 1*a* and 1*c* while the depression rolls 2*b* and 2*d* are placed away from the label so that printing with the corresponding printing heads 1*b* and 1*d* is not performed.

The label X as the printing object is adapted to be fed from a label reel 9 and guided by a label guide 20. A pair of feed rollers 7, 7 are provided in vertical alignment to each other and opposes across a label path defined therebetween for feeding the label X toward right in the drawing. The label X printed by the printing heads 1 is cut into individual labels in a next process step or is peeled from a release backing paper so forth and stuck on a predetermined object. The reference numeral 21 denotes a label take-up reel for taking up the release backing paper after peeling off the labels.

Figure 5:
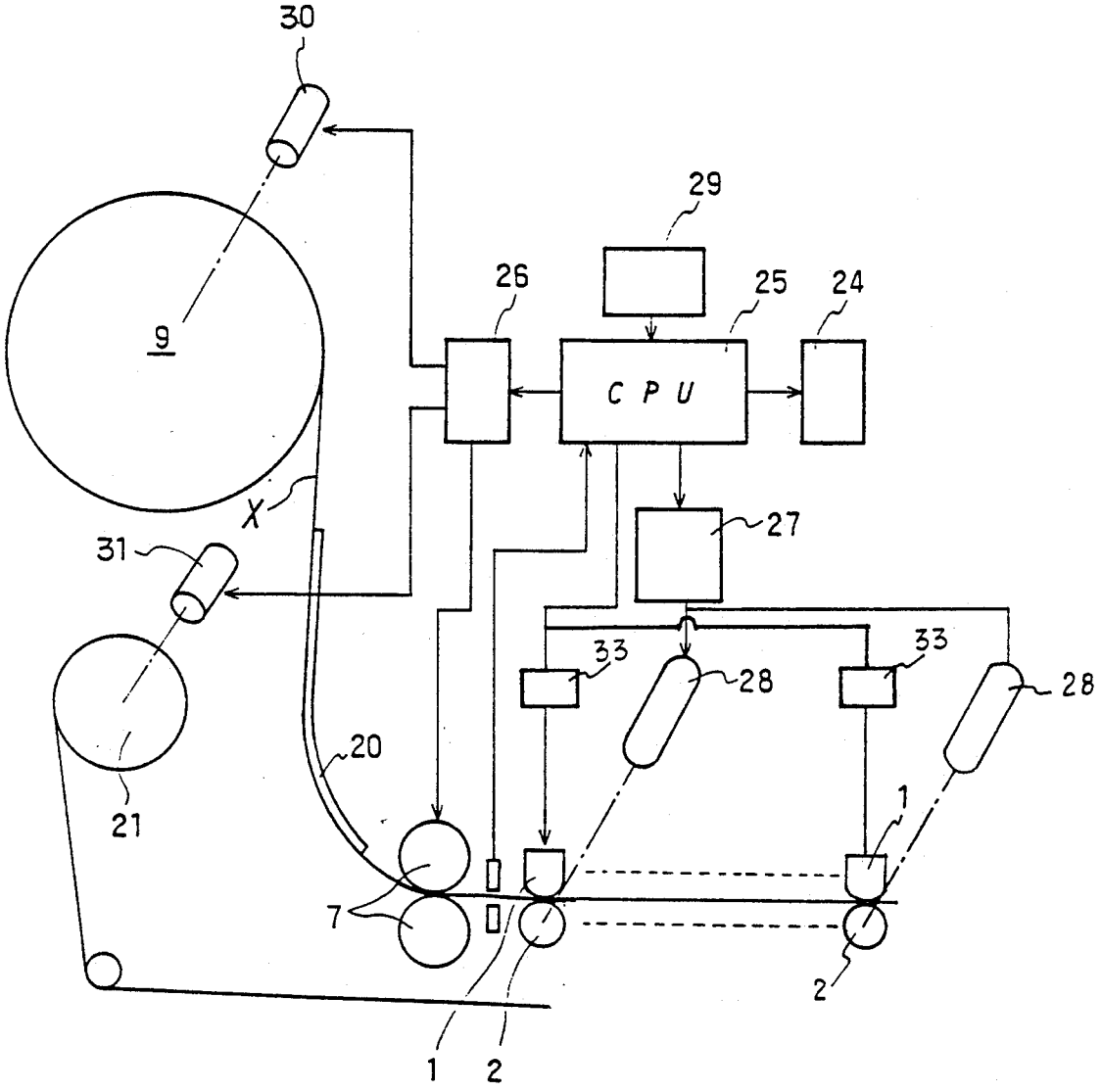
FIG. 5 is a schematic diagrammatic illustration showing a control system to be employed in the preferred embodiment of the multiple printing apparatus according to the present invention.

FIG. 5 shows one embodiment of a control system for controlling operation of the shown embodiment of the multiple printing apparatus constructed as set forth above. The control system generally includes the control mechanisms and drive mechanisms for governing overall operation of the shown embodiment of the multiple printing apparatus. As can be seen, respective printing heads 1 are coupled with drive mechanisms 33 which drive the printing heads. The label reel 9 and the label take-up reel 21 are adapted to be rotatingly driven by motors 30 and 31. Also, the shown embodiment specifically refers to the reel 9 as label reel, and the reel 21 as take-up reel, the reel 21 may be the label reel and the reel 9 may be the take-up reel when the label feeding direction is directed to be reversed. In the shown embodiment, the label reel g is normally held free to freely feeds the label.

The motors 30 and 31 are connected to a driver circuit 26 which is, in turn, connected to a microcomputer based control unit 25. The control unit 25 outputs reel control signals for controlling operation of the motors 30 and 31 for smoothly feeding the labels in synchronism with printing operation. The control unit 25 further controls operation of the feed rollers 7 for synchronous operation with the motors 30 and 31 so that the label web X can be fed through register positions for printing.

Transmission type sensors 22 are provided upstream side of respective printing feds for detecting the label blank x on the label web X with a series of release backing paper. Although the sensors 22 are provided only at the upstream side of the printing heads 1, it may also possible to provide the sensors at both of the upstream and downstream sides of the printing heads. Each sensor 22 is adapted to produce a label detection signal when the label blank x is detected. The label detection signal is input t the control unit 25. The control unit 25 uses the label detection signal for counting number of label blanks x and as well as for control of the printing operation.

The control unit 25 further controls the driver 33 of the printing heads 1 for driving the latter between the uppermost position and the lowermost position. As well, the control unit 25 is connected to a driver circuit 27 which is, in turn, connected to an electromagnetic solenoids 28 for driving the depression rolls 2 between the upwardly and downwardly shifted positions. Namely, as set out, since the printing is performed only when the depression roll 2 is upwardly shifted to urge the label blank X onto the corresponding printing head 1 via the ink ribbon Y, the control unit 25 selectively energizes the selected solenoids corresponding to desired colors of printing heads by feeding selection signal to the driver circuit 27.

In the shown construction, the control unit 25 is associated with a manually operable operation unit 29 for entering various commands for printing operation therethrough. Also, a display unit 24 may be provided for providing various indication, such as number of labels printed, operation parameters or so forth.

It should be noted that the feeding reel 3, the take-up reel 4, the feeding rollers 7, depression rolls 2 and the printing heads 1 may also be controlled by any other control mechanisms and driven by driving mechanisms appropriate to perform the desired operations. Therefore, the foregoing embodiment of the control system should be understood as exemplary embodiment.

It should be noted that although the shown embodiment employs the printing heads 1 for thermal printing, it may be replaced with dot impact printer heads. In the further alternative, laser printer heads may also be employed in place of the thermal printing heads.

Operation of the multiple printing apparatus as set forth above will be discussed herebelow.

At first, the cassettes 50*a*, 50*b*, 50*c* and 50*d* are released from the main body B. Then, desired colors of ink ribbons Y are set on respective of the feeding reels 3. The leading end portion of each ink ribbon Y is wrapped on the outer guide 5 and then wound on the take-up reel 4. After setting the ink ribbons Y, the cassettes 50*a*, 50*b*, 50*c* and 50*d* are mounted on the main body B. At this time, the respective printing heads 1 are held at the uppermost throw-off position so that they may be received in the cut out of respectively corresponding cassettes 50. Thereafter, the label X in an elongated web form is set on the label reel 9. The leading end portion of the label X is grasped between the feeding rollers 7 across the label guide 20 and initially fed for a given length. Then, the printing heads 1 are shifted down to the lowermost positions and latched in place by suitable latch mechanisms.

Through the sequence of preparatory operation, printing ready state can be established. Then, the feeding rollers 7 are driven by a signal from the control mechanism for feeding the label in synchronism with printing operation. Also, the vertical positions of the depression rolls 2 are controlled by control signals for performing printing by the selected printing head or heads with desired colors of ink ribbons Y.

With the construction set forth above, it becomes unnecessary to reciprocally shift the label X even when multi-stage or multi-color printing is to be performed and can perform multi-stage or multi-color printing of a plurality of stages corresponding to the number of printing head by one sequence of feed in one direction. Therefore, it becomes possible to perform multi-stage or multi-color printing in a shorter period than that in the conventional apparatus. Also, since the printing heads are movable in the vertical direction to be placed at the upwardly shifted throw-off positions, adjustment, maintenance or so forth of the printing heads can be easily performed even when the printing heads can be arranged with high density. Furthermore, since the printing can be performed selectively by vertical motion of the depression rolls 2, the printing heads 1 are not required to be shifted vertically. This contributes simplification of the construction of the printing head to permit arrangement of printing heads with high density. Also, by mounting the ink ribbons Y above the printing heads and arranging those in stepwise fashion so that the ink ribbons can be supplied from the immediately above the printing heads, it can achieve high space efficiency to enable high density arrangement. In addition, since it becomes unnecessary to arrange anything at the position downstream of the printing head at the most downstream side, it may facilitate connection with the equipment in the following stage.

As set forth above, since the multiple printing apparatus according to the present invention comprises a plurality of printing heads arranged along the feeding direction of the printing object fed relative thereto and control means selectively performing printing with at least two printing head, reciprocal movement of the printing object becomes unnecessary to permit multiple printing at extremely high speed by one sequence of feed in one direction.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A multiple printing apparatus comprising:

a plurality of printing heads, means for moving each of said printing heads in vertical direction between printing positions and throw-off positions, a plurality of said printing positions being arranged at a straight line in series along a direction of relative motion between a printing object and said printing heads, a plurality of said throw-off positions being disposed at vertically different positions above respectively corresponding printing positions so that said plurality of said throw-off positions are arranged in step-wise fashion, a plurality of printing medium strips each set on a respective feeding roll and a respective take-up roll, and disposed beneath a respective one of said plurality of printing heads and above said printing object, for transferring a printing image onto the printing object at active state of said respective one of said plurality of printing heads, control means for selectively controlling each of said printing heads between said printing position and said throw-off position independently of the other printing heads; and a plurality of assemblies of said feeding roll and said takeup roll being disposed at respectively corresponding throw-off positions in stepwise fashion, each of said printing medium strips being extended from the feeding roll to the printing positions together with said respective one of said printing heads when the printing heads shift down to the printing positions from the throwoff positions.

2. A multiple printing apparatus as set forth in claim 1, wherein said printing heads are thermal printing heads, said printing medium strips are thermal printing mediums; and further comprising means disposed beneath said printing object in opposition to each of said printing heads, for depressing and releasing said printing object toward and away from said printing heads for selectively performing printing.

3. A multiple printing apparatus as set forth in claim 1, wherein each printing medium strip is adapted to print in color and wherein the color in which each printing medium strip rints is different from the color in which at least one other medium strip prints.

4. A multiple printing apparatus as set forth in claim 1, wherein a plurality of assemblies of said feeding roll and said take-up roll on which the corresponding printing medium strip is provided are attachable and detachable at corresponding throw-off positions.

5. A multiple printing apparatus comprising:

a plurality of thermal printing heads, means for moving each of said printing heads in vertical direction between printing positions and throw-off positions, a plurality of said printing positions being arranged at a straight line in series along a direction of relative motion between a printing object and said printing heads, a plurality of said throw-off positions being disposed at vertically different positions above respectively corresponding printing positions so that said plurality of said throw-off positions are arranged in step-wise fashion, a plurality of thermal printing ink ribbons each set on a respective feeding roll and a respective takeup roll, and disposed beneath a respective one of said plurality of thermal printing heads and above said printing object, for transferring a printing image onto the printing object at active state of said respective one of said plurality of thermal printing heads, means disposed beneath said printing object in opposition to each of said thermal printing heads, for depressing and releasing said printing object toward and away from each of said thermal printing heads for selectively performing printing, control means for selectively controlling each of said thermal printing heads between said printing position and said throw-off position independently of the other printing in said plurality of printing heads; and a plurality of assemblies of said feeding roll and said take-up roll being disposed respectively at corresponding throw-off positions in stepwise fashion, each of said thermal printing ink ribbons being extended from its feeding roll to the printing positions together with said respective one of said printing heads when the printing heads shift down to the printing positions from the throw-off positions.

* * * * *